US011431155B2

(12) United States Patent
Ban et al.

(10) Patent No.: US 11,431,155 B2
(45) Date of Patent: Aug. 30, 2022

(54) SPARK PLUG

(71) Applicant: NGK SPARK PLUG CO., LTD., Nagoya (JP)

(72) Inventors: Kenji Ban, Nagoya (JP); Tatsuya Gozawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/283,203

(22) PCT Filed: Jun. 23, 2020

(86) PCT No.: PCT/JP2020/024543
§ 371 (c)(1),
(2) Date: Apr. 6, 2021

(87) PCT Pub. No.: WO2021/024632
PCT Pub. Date: Feb. 11, 2021

(65) Prior Publication Data

US 2021/0359495 A1 Nov. 18, 2021

(30) Foreign Application Priority Data

Aug. 7, 2019 (JP) ..... JP2019-145087

(51) Int. Cl.
*H01T 13/54* (2006.01)

(52) U.S. Cl.
CPC ..... *H01T 13/54* (2013.01)

(58) Field of Classification Search
CPC ..... H01T 13/54
(Continued)

(56) References Cited

U.S. PATENT DOCUMENTS

2007/0283916 A1 12/2007 Bachmaier et al.
2009/0107438 A1* 4/2009 Baldwin ..... H01T 13/26 123/146.5 R (Continued)

FOREIGN PATENT DOCUMENTS

CN 102185255 A 9/2011
JP 2008-186667 8/2008

(Continued)

OTHER PUBLICATIONS

Office Action (with English machine translation) dated Aug. 26, 2021 from corresponding Chinese Patent Application No. 202080005216.0.

(Continued)

*Primary Examiner* — Christopher M Raabe
(74) *Attorney, Agent, or Firm* — Kusner & Jaffe

(57) ABSTRACT

A spark plug includes a metal shell and a cap member joined to the metal shell to define a pre-chamber. The cap member includes an overlapping surface that overlaps the metal shell along the axial line direction, an inner facing surface positioned closer to the pre-chamber than is the overlapping surface, the inner facing surface facing the metal shell in the axial line direction, and an outer facing surface positioned closer to an outer periphery than is the overlapping surface, the outer facing surface facing the metal shell in the axial line direction. A portion of the cap member that is closer to the pre-chamber than is the overlapping surface s spaced from the metal shell. The metal shell and the cap member are joined together at at least one of the outer facing surface and the overlapping surface.

3 Claims, 7 Drawing Sheets

(58) Field of Classification Search
USPC ..... 313/141
See application file for complete search history.

(56) References Cited

U.S. PATENT DOCUMENTS

| | | | | |
|---|---|---|---|---|
| 2011/0148274 | A1 | 6/2011 | Ernst et al. | |
| 2014/0165980 | A1* | 6/2014 | Chiera | H01T 13/32 123/704 |
| 2015/0194793 | A1 | 7/2015 | Yamanaka | |
| 2016/0079739 | A1 | 3/2016 | Okazaki et al. | |
| 2016/0254650 | A1* | 9/2016 | Maul | H01T 13/54 123/169 EL |
| 2020/0036166 | A1* | 1/2020 | Kuhnert | H01T 21/02 |
| 2020/0287358 | A1* | 9/2020 | Gozawa | H01T 13/54 |

FOREIGN PATENT DOCUMENTS

| | | |
|---|---|---|
| JP | 2015-130302 A | 7/2015 |
| JP | 2016-062664 | 4/2016 |
| JP | 2019-087333 | 6/2019 |

OTHER PUBLICATIONS

International Search Report from corresponding International Patent Application No. PCT/JP20/24543, dated Aug. 11, 2020.

* cited by examiner

SPARK PLUG

FIELD OF THE INVENTION

The present invention relates to a spark plug including a pre-chamber for a combustion chamber of an engine.

BACKGROUND OF THE INVENTION

An example of a known spark plug includes a cap member joined to a cylindrical metal shell that extends in an axial line direction, the cap member being exposed in a combustion chamber of an engine to define a pre-chamber. See Japanese Unexamined Patent Application Publication No. 2015-130302 (Patent Document 1). This type of spark plug ignites combustible air-fuel mixture that has flowed into the pre-chamber from the combustion chamber through a through hole formed in the cap member. The combustible air-fuel mixture is combusted to generate an expansion pressure that causes a gas flow including flame to be injected into the combustion chamber through the through hole. The combustible air-fuel mixture in the combustion chamber is combusted by the injected flow of flame. Therefore, variation in combustion in the combustion chamber is affected by the position of the pre-chamber in the combustion chamber.

The spark plug is configured such that the cap member joined to the metal shell in the axial line direction is exposed in the combustion chamber. Therefore, to control the variation in combustion in the combustion chamber, there is a need for reduction in variation in the length of the cap member from the metal shell in the axial line direction.

SUMMARY OF THE INVENTION

The present invention has been made to address the need in the prior art, and an object of the present invention is to provide a spark plug including a cap member with reduced variation in the length thereof from a metal shell in an axial line direction.

Solution to Problem

To achieve the above-described object, a spark plug according to the present invention includes a metal shell having a tubular shape and extending along an axial line in a direction from front to back; a center electrode retained inside an inner periphery of the metal shell in an insulated manner; a ground electrode that is electrically connected to the metal shell and that defines a spark gap between the center electrode and an end portion of the ground electrode; and a cap member that is joined to the metal shell, that covers the center electrode and the end portion of the ground electrode from the front to define a pre-chamber, and in which a through hole is formed. The cap member includes an overlapping surface that overlaps a front end portion of the metal shell along the axial line direction; an inner facing surface positioned closer to the pre-chamber than is the overlapping surface, the inner facing surface facing the metal shell in the axial line direction; and an outer facing surface positioned closer to an outer periphery than is the overlapping surface, the outer facing surface facing the metal shell in the axial line direction. A portion of the cap member that is closer to the pre-chamber than is the overlapping surface is spaced from the metal shell. The metal shell and the cap member are joined together at at least one of the outer facing surface and the overlapping surface.

Advantageous Effects of Invention

According to the spark plug of aspect 1, the overlapping surface of the cap member overlaps the front end portion of the metal shell along the axial line direction. The inner facing surface of the cap member, which is positioned closer to the pre-chamber than is the overlapping surface, faces the metal shell in the axial line direction. The outer facing surface of the cap member, which is positioned closer to the outer periphery than is the overlapping surface, faces the metal shell in the axial line direction. The metal shell and the cap member are joined together at at least one of the outer facing surface and the overlapping surface.

Since the portion of the cap member that is closer to the pre-chamber than is the overlapping surface is spaced from the metal shell, when the spark plug is manufactured, the cap member can be joined to the metal shell while a portion of the cap member that is outside the overlapping surface is in contact with the metal shell. Since the manner in which the outer portion of the cap member is in contact with the metal shell can be checked from the outside of the cap member when the cap member is joined to the metal shell, the length of the cap member from the metal shell in the axial line direction can be controlled with reference to the portion of the cap member that is in contact with the metal shell. Therefore, compared to the case in which the cap member is positioned with reference to the inner facing surface of the cap member, which cannot be checked from the outside of the cap member, when the cap member is joined to the metal shell, variation in the length of the cap member from the metal shell in the axial line direction can be reduced.

According to the spark plug of aspect 2, the inner facing surface is positioned further back from the outer facing surface in the axial line direction, and the overlapping surface is in contact with the metal shell. Therefore, when the cap member is joined to the metal shell, the cap member is inserted into the metal shell such that the overlapping surface slides along the metal shell. Thus, the cap member can be temporarily attached to the metal shell by friction.

When the cap member is inserted into the metal shell, the corner between the inner facing surface and the overlapping surface of the cap member slides along the metal shell, and shavings are generated accordingly. If the generated shavings enter the pre-chamber, the shavings may serve as a source of pre-ignition. However; since the corner between the inner facing surface and the overlapping surface of the cap member is chamfered or rounded, the chamfered or rounded portion defines a space capable of receiving the shavings. As a result, even when the shavings are generated, the shavings do not easily enter the pre-chamber. Therefore, not only can the effects of aspect 1 be obtained, but also the occurrence of pre-ignition due to the shavings serving as a source can be reduced.

According to the spark plug of aspect 3, the corner between the inner facing surface and the overlapping surface of the cap member is rounded. Accordingly, shavings are not easily generated when the cap member is inserted into the metal shell. Therefore, not only can the effects of Claim 2 be obtained, but also the occurrence of pre-ignition due to the shavings serving as a source can be further reduced.

DETAILED DESCRIPTION OF THE INVENTION

Figure 1:
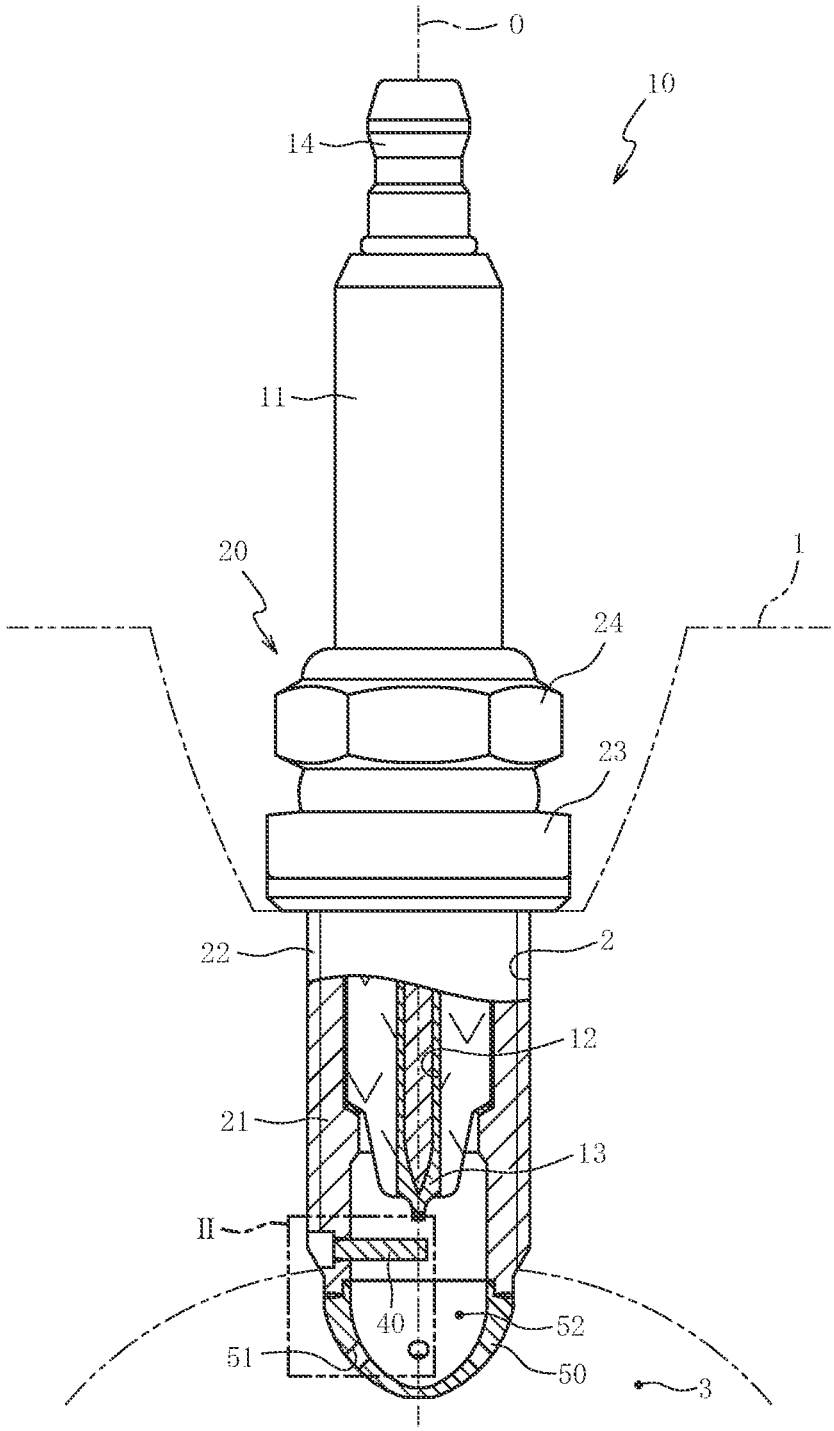
FIG. 1 is a partially sectioned view of a spark plug according to a first embodiment.
Figure 2:
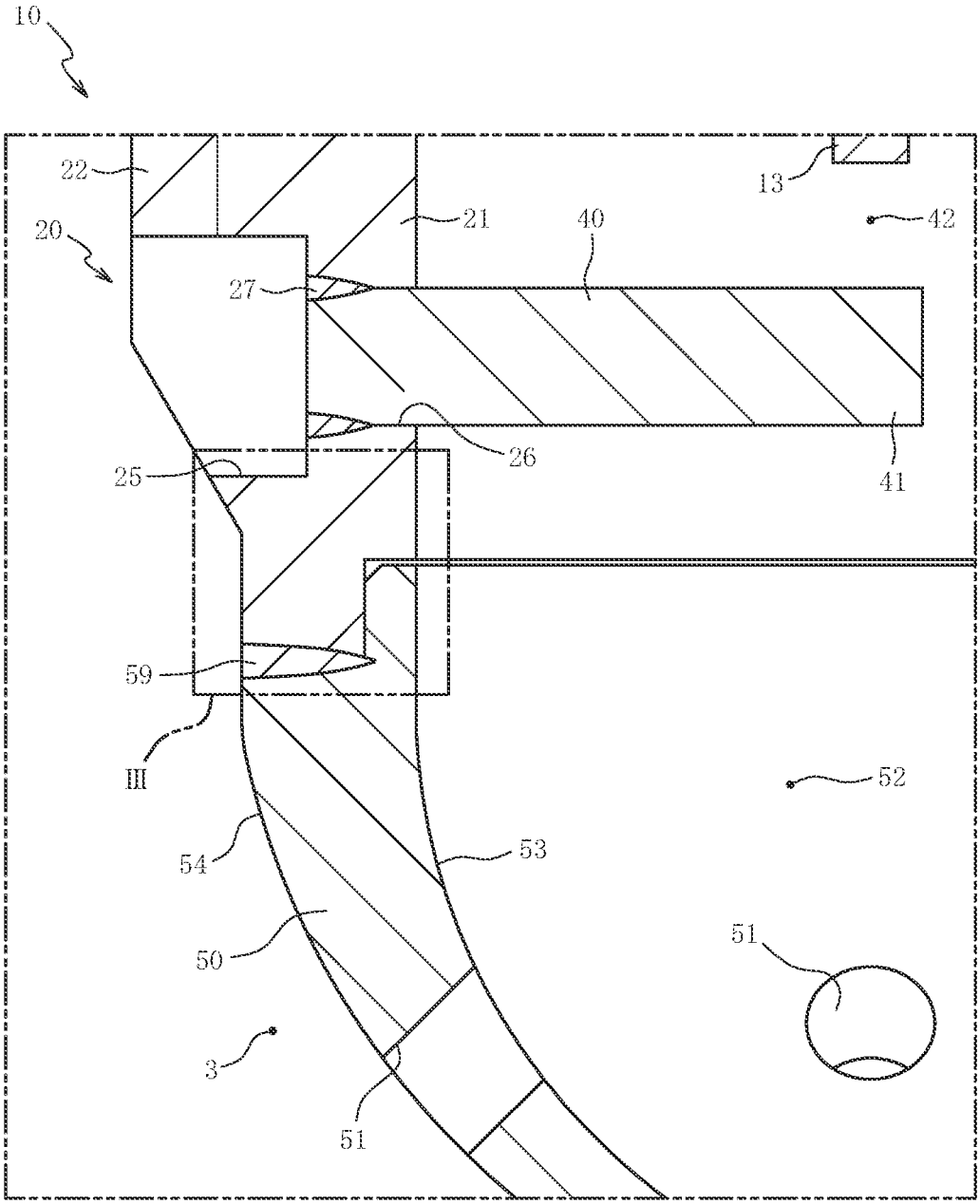
FIG. 2 is an enlarged partial sectional view of the spark plug illustrating part II in FIG. 1.

Preferred embodiments of the present invention will now be described with reference to the accompanying drawings. FIG. 1 is a partially sectioned view of a spark plug 10 according to an embodiment. FIG. 1 shows a cross section of a front portion of the spark plug 10 including an axial line O. The bottom of FIG. 1 is defined as the front of the spark plug 10, and the top of FIG. 1 is defined as the back of the spark plug 10 (this also applies to FIGS. 2 to 7), FIG. 2 is an enlarged partial sectional view of the spark plug 10 including the axial line O, illustrating part II in FIG. 1. As illustrated in FIG. 1, the spark plug 10 includes an insulator 11, a center electrode 13, a metal shell 20, a ground electrode 40, and a cap member 50.

The insulator 11 is a substantially cylindrical member having an axial hole 12 that extends along the axial line O, and is made of a ceramic, such as alumina, having good mechanical characteristics and high insulation properties at high temperatures. The center electrode 13 is disposed in a front region of the axial hole 12 in the insulator 11. The center electrode 13 is electrically connected to a metal terminal 14 in the axial hole 12. The metal terminal 14 is a rod-shaped member to which a high-voltage cable (not shown) is connected, and is made of a conductive metal material (for example, low-carbon steel). The metal terminal 14 is fixed to the back end of the insulator 11.

The metal shell 20 is a substantially cylindrical member made of a conductive metal material (for example, low-carbon steel). The metal shell 20 includes a front end portion 21 having an external thread 22 formed on an outer peripheral surface thereof, a seating portion 23 that is adjacent to and behind the front end portion 21, and a tool engagement portion 24 formed behind the seating portion 23. The external thread 22 is screwed into a threaded hole 2 in an engine 1. The seating portion 23 is a portion that seals a clearance between the threaded hole 2 in the engine 1 and the external thread 22, and has an outer diameter greater than the outer diameter of the external thread 22. The tool engagement portion 24 engages with a tool, such as a wrench, used to screw the external thread 22 into the threaded hole 2 in the engine 1.

The ground electrode 40 is a rod-shaped member made of a metal material containing, for example, Pt as a main component. In the present embodiment, the ground electrode 40 is disposed at a position where the external thread 22 is provided, and extends through the front end portion 21 to project into the inside of the front end portion 21. An end portion 41 (see FIG. 2) of the ground electrode 40 faces the center electrode 13. The cap member 50 is connected to the front end portion 21 of the metal shell 20. The main component of the material of the ground electrode 40 is not limited to the above-described element, and may, of course, instead be other elements, Examples of other elements include Ni and Ir.

The cap member 50 is a hemispherical member that covers the center electrode 13 and the end portion 41 (see FIG. 2) of the ground electrode 40 from the front. The cap member 50 is made of a metal material containing, for example, Fe as a main component. The cap member 50 has through holes 51 in a region in front of the ground electrode 40. When the spark plug 10 is installed by screwing the external thread 22 into the threaded hole 2 in the engine 1, the cap member 50 is exposed in a combustion chamber 3 of the engine 1. The through holes 51 connect a pre-chamber 52, which is defined by the cap member 50, to the combustion chamber 3. The main component of the material of the cap member 50 is not limited to the above-described element, and may, of course, instead be other elements. Examples of other elements include Ni and Cu.

As illustrated in FIG. 2, the front end portion 21 of the metal shell 20 has a recess 25 that is recessed radially inward in a region where the external thread 22 is provided. The front end portion 21 also has a hole 26, which is thinner than the recess 25, in a region radially inside the recess 25. The hole 26 extends through the front end portion 21 in a radial direction. The ground electrode 40 is inserted in the hole 26 and joined to the front end portion 21 by a welded portion 27. A spark gap 42 is formed between the end portion 41 of the ground electrode 40 and the center electrode 13. Since the ground electrode 40 is joined to the metal shell 20 in the region where the external thread 22 is provided, heat is transferred from the ground electrode 40 to the engine 1 through the external thread 22.

Figure 3:
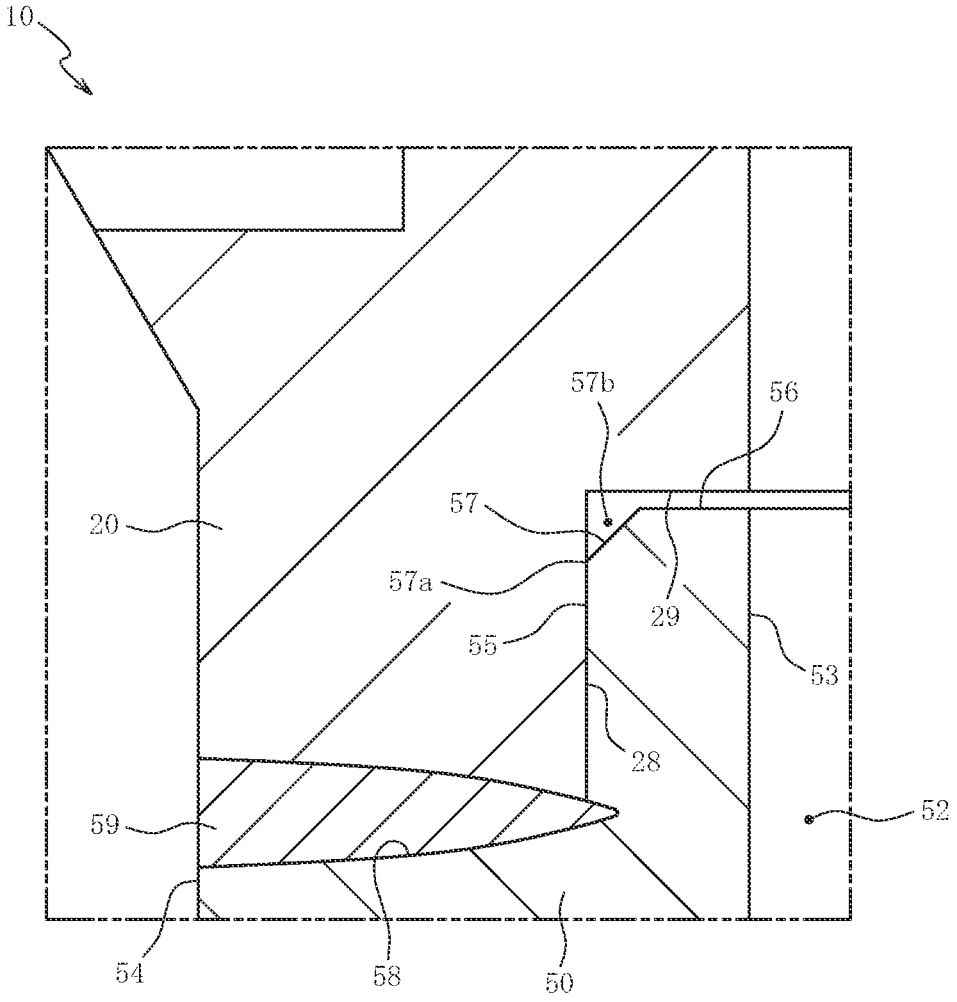
FIG. 3 is an enlarged partial sectional view of the spark plug illustrating part III in FIG. 2.

FIG. 3 is an enlarged sectional view of the spark plug 10 illustrating part III in FIG. 2. An inner surface 53 of the cap member 50 faces the pre-chamber 52, and an outer surface 54 of the cap member 50 faces the combustion chamber 3. The cap member 50 includes an overlapping surface 55 that faces the front end portion 21 of the metal shell 20 along the axial line direction (up-down direction in FIG. 3); an inner facing surface 56 that faces the front end portion 21 of the metal shell 20 in the axial ne direction and that is positioned closer to the pre-chamber 52 than is the overlapping surface 55; and an outer facing surface 58 that faces the front end portion 21 of the metal shell 20 in the axial line direction and that is positioned outside (closer to the combustion chamber 3 than) the overlapping surface 55.

The cap member 50 is joined to the metal shell 20 by a welded portion 59. The welded portion 59 is formed by melting the cap member 50 and the metal shell 20. The welded portion 59 extends along the entire circumference of the metal shell 20 and the cap member 50.

The overlapping surface 55 is an outwardly facing cylindrical surface of the cap member 50, and extends over the entire circumference of the cap member 50. The overlapping surface 55 is in contact with a first surface 28 of the metal shell 20, which is an inwardly facing cylindrical surface. The distance between the inner surface 53 and the overlapping surface 55 of the cap member 50 is, for example, 0.2 mm to 0.6 mm.

The inner facing surface 56 is a back-facing annular surface, and extends over the entire circumference of the cap member 50. The inner facing surface 56 intersects the inner surface 53 of the cap member 50. The inner facing surface 56 is spaced from a second surface 29 of the metal shell 20, which is a front-facing annular surface. The distance between the inner facing surface 56 of the cap member 50 and the second surface 29 of the metal shell 20 in the axial line direction (gap size) is, for example, about 0.02 mm to about 0.8 mm.

The corner between the overlapping surface 55 and the inner facing surface 56 of the cap member 50 is chamfered so that the corner is obliquely cut off to form an inclined surface 57 that extends over the entire circumference of the cap member 50. The inclined surface 57 intersects the overlapping surface 55 and the inner facing surface 56.

The outer facing surface 58 is a back-facing annular surface, and extends over the entire circumference of the cap member 50. The outer facing surface 58 intersects the outer surface 54 of the cap member 50. The inner facing surface 56 is positioned further back from the outer facing surface 58. In the present embodiment, the entirety of the outer facing surface 58 constitutes the boundary surface between the welded portion 59 and the cap member 50.

Figure 4:
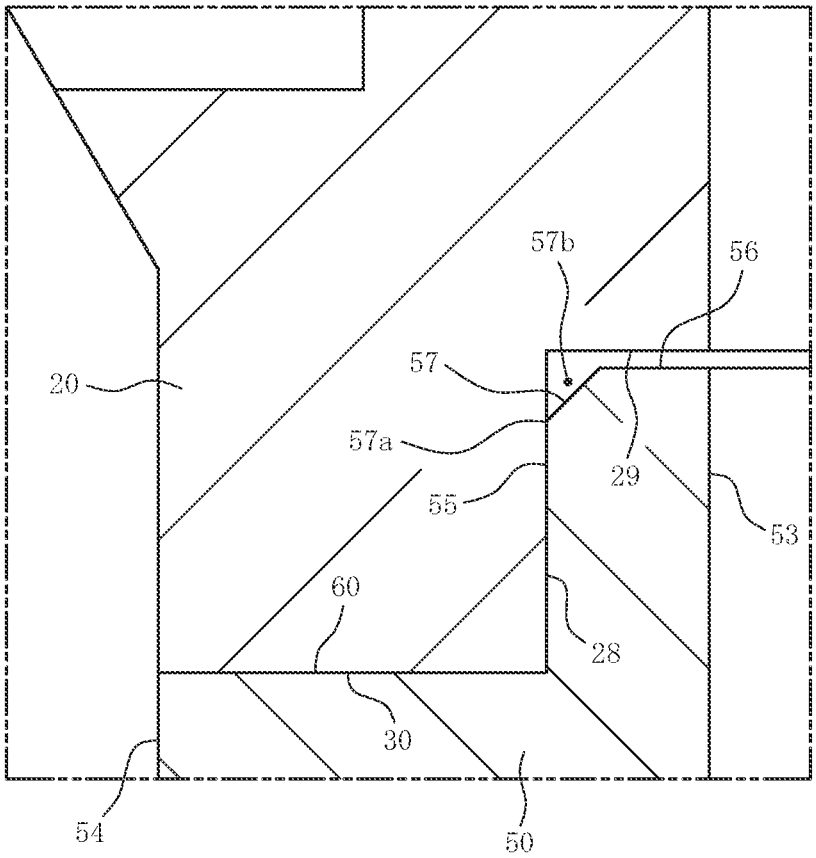
FIG. 4 is a sectional view of a metal shell and a cap member before a welded portion is formed.

FIG. 4 is a sectional view of the metal shell 20 and the cap member 50 before the welded portion 59 is formed, taken along a plane including the axial line O. FIG. 4 is an enlarged partial sectional view of the spark plug 10 illustrating part III in FIG. 2 before the welded portion 59 is formed, taken along a plane including the axial line O.

To form the welded portion 59 (see FIG. 2) in the process of manufacturing the spark plug 10, the cap member 50 is inserted into the metal shell 20 such that the overlapping surface 55 of the cap member 50 slides along the first surface 28 of the metal shell 20 until an outer facing surface 60 of the cap member 50 comes into contact with a third surface 30 of the metal shell 20. The outer facing surface 60 of the cap member 50 is a back-facing annular surface that is disposed outside the overlapping surface 55 of the cap member 50. The third surface 30 of the metal shell 20 is a front-facing annular surface and that is disposed outside the first surface 28 of the metal shell 20.

When the outer facing surface 60 of the cap member 50 is in contact with the third surface 30 of the metal shell 20, the inner facing surface 56 and the inclined surface 57 are spaced from the second surface 29 of the metal shell 20. The cap member 50 is temporarily attached to the metal shell 20 due to friction between the overlapping surface 55 and the first surface 28 of the metal shell 20. In this state, the outer facing surface 60 of the cap member 50, the third surface 30 of the metal shell 20, and portions around these surfaces are melted by, for example, irradiation with a laser beam to form the welded portion 59 (see FIG. 2). Thus, the cap member 50 is joined to the metal shell 20.

Although the inner facing surface 56 cannot be checked from the outside of the cap member 50, the manner in which the outer facing surface 60 of the cap member 50 is in contact with the third surface 30 of the metal shell 20 can be checked from the outside of the cap member 50. By controlling the positional accuracies of the third surface 30 of the metal shell 20 and the outer facing surface 60 of the cap member 50 and confirming that no foreign object or the like is present between the third surface 30 and the outer facing surface 60 from the outside of the cap member 50, the length of the cap member 50 from the metal shell 20 in the axial line direction can be controlled with reference to the outer facing surface 60 that is in contact with the third surface 30. Therefore, compared to the case in which the cap member 50 that is not yet joined is positioned in the axial line direction with reference to the inner facing surface 56, which cannot be checked from the outside of the cap member 50, variation in the length of the cap member 50 from the metal shell 20 in the axial line direction can be reduced.

When the cap member 50 is inserted into the space inside the first surface 28 of the metal shell 20, a corner 57*a* between the overlapping surface 55 and the inclined surface 57 slides along the first surface 28 of the metal shell 20. Therefore, there is a possibility that shavings will be generated. If the generated shavings enter the pre-chamber 52, the shavings may serve as a source of pre-ignition. However, since the corner between the inner facing surface 56 and the overlapping surface 55 of the cap member 50 is chamfered, a space 57*b* capable of receiving the shavings is formed between the inclined surface 57 and the metal shell 20. As a result, even when the shavings are generated, the shavings do not easily enter the pre-chamber 52. Therefore, the occurrence of pre-ignition due to the shavings serving as a source can be reduced.

Figure 5:
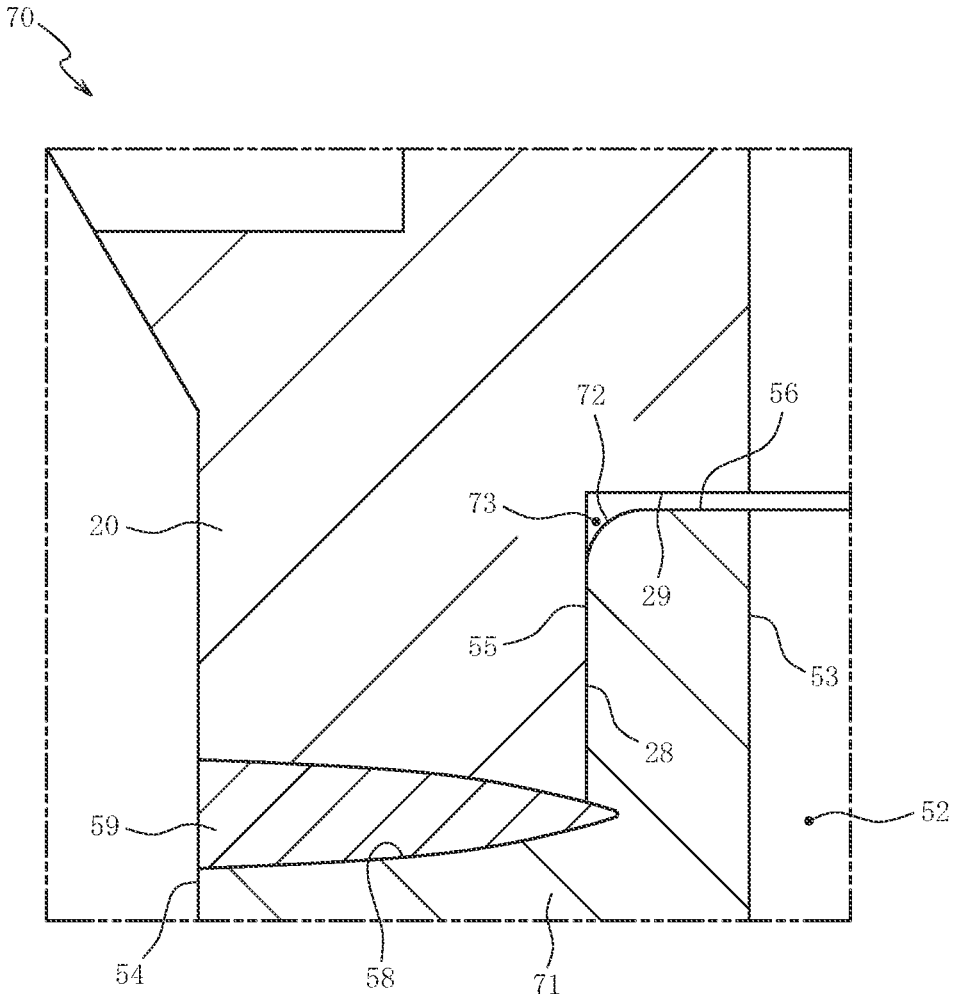
FIG. 5 is a sectional view of a spark plug according to a second embodiment.

A second embodiment will now be described with reference to FIG. 5. In the first embodiment, the corner between the overlapping surface 55 and the inner facing surface 56 of the cap member 50 is obliquely cut off so that the inclined surface 57 is formed. In contrast, in the second embodiment, the corner between an overlapping surface 55 and an inner facing surface 56 of a cap member 71 is rounded.

Components that are the same as those described in the first embodiment are denoted by the same reference signs, and description thereof will be omitted. FIG. 5 is a sectional view of a spark plug 70 according to the second embodiment. Similar to FIG. 3, FIG. 5 is an enlarged partial sectional view of the spark plug 70 illustrating part III in FIG. 2, taken along a plane including the axial line O (this also applies to FIGS. 6 and 7).

The spark plug 70 is configured such that the cap member 71 is joined to the front end portion 21 of the metal shell 20 by the welded portion 48. The corner between the overlapping surface 55 and the inner facing surface 56 of the cap member 71 is rounded so that a curved surface 72 that is smoothly connected to the overlapping surface 55 and the inner facing surface 56 is formed on the cap member 71.

To from the welded portion 59 in the process of manufacturing of the spark plug 70, the cap member 71 is inserted into the space inside the first surface 28 of the metal shell 20. When the outer facing surface 60 (see FIG. 4) of the cap member 71 comes into contact with the third surface 30 of the metal shell 20 to stop further insertion of the cap member 71, the inner facing surface 56 and the curved surface 72 are spaced from the metal shell 20. The cap member 71 is temporarily attached to the metal shell 20 due to friction between the overlapping surface 55 and the first surface 28 of the metal shell 20.

When the cap member 71 is inserted into the space inside the first surface 28 of the metal shell 20, a portion between the overlapping surface 55 and the curved surface 72 slides along the first surface 28 of the metal shell 20. However, since the overlapping surface 55 and the curved surface 72 are smoothly connected to each other, shavings are not easily generated. Since shavings that may serve as a source of pre-ignition are not easily generated, the occurrence of pre-ignition can be reduced. Even when shavings are generated, since a space 73 capable of receiving the shavings is formed between the curved surface 72 and the metal shell 20, the shavings do not easily enter the pre-chamber 52. Therefore, the occurrence of pre-ignition due to the shavings serving as a source can be reduced.

Figure 6:
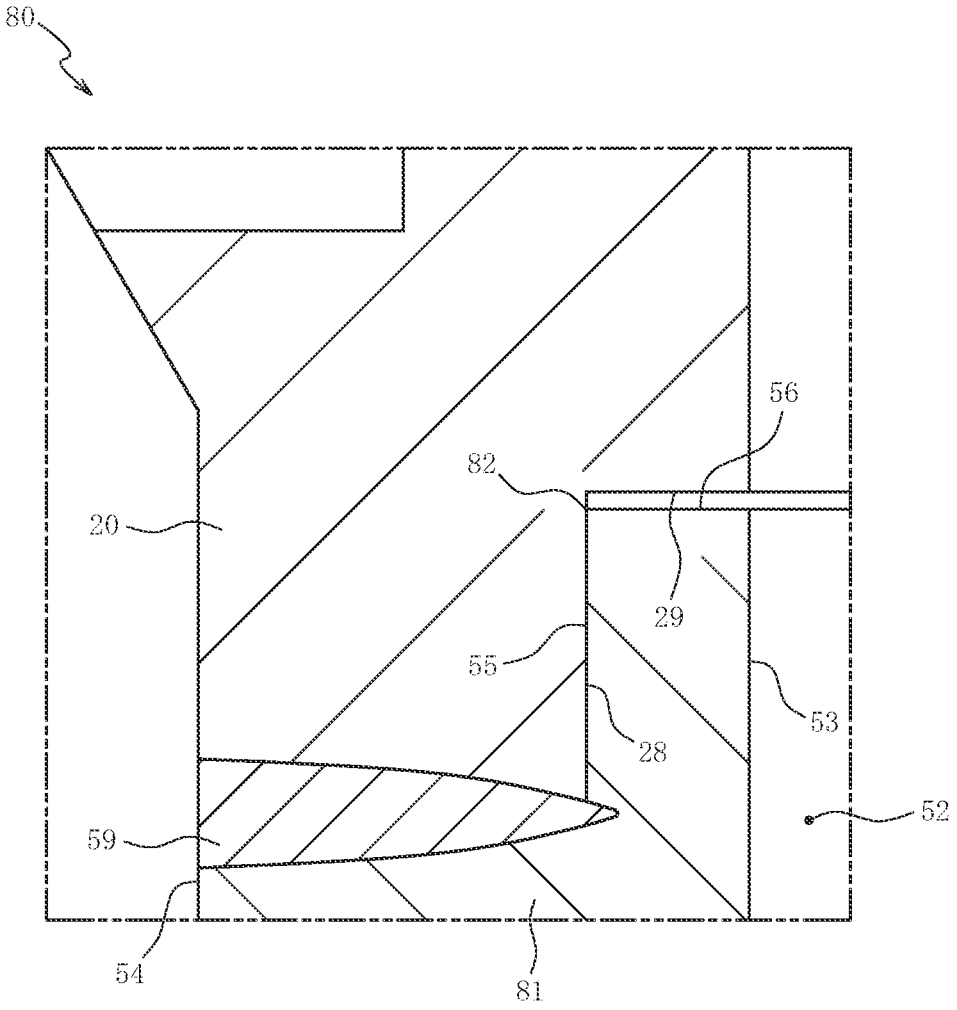
FIG. 6 is a sectional view of a spark plug according to a third embodiment.

A third embodiment will now be described with reference to FIG. 6. In the first and second embodiments, the corner between the overlapping surface 55 and the inner facing surface 56 of the cap member 50, 71 is chamfered or rounded. In contrast, in the third embodiment, the corner between an overlapping surface 55 and an inner facing surface 56 of a cap member 81 is not chamfered or rounded. Components that are the same as those described in the first embodiment are denoted by the same reference signs, and description thereof will be omitted. FIG. 6 is a sectional view of a spark plug 80 according to the third embodiment.

The spark plug 80 is configured such that the cap member 81 is joined to the front end portion 21 of the metal shell 20 by the welded portion 59. The inner facing surface 56 of the cap member 81 is spaced from the second surface 29 of the metal shell 20. Accordingly, by controlling the positional accuracies of the third surface 30 (see FIG. 4) of the metal shell 20 and the outer facing surface 60 of the cap member 81 and confirming that no foreign object or the like is present between the third surface 30 and the outer facing surface 60 from the outside of the cap member 81, the length of the cap member 81 from the metal shell 20 in the axial line direction can be controlled with reference to the outer facing surface 60 that is in contact with the third surface 30. Therefore, compared to the case in which the cap member 81 that is not yet joined is positioned in the axial line direction with reference to the inner facing surface 56, which cannot be checked from the outside of the cap member 81, variation in the length of the cap member 81 from the metal shell 20 in the axial line direction can be reduced.

When the cap member 81 is inserted into the space inside the first surface 28 of the metal shell 20, a corner 82 between the overlapping surface 55 and the inner facing surface 56 slides along the first surface 28 of the metal shell 20. Therefore, there is a possibility that shavings will be generated. However, when the gap between the inner facing surface 56 of the cap member 81 and the second surface 29 of the metal shell 20 is as small as about 0.02 mm to about 0.8 mm, gas does not easily flow through the gap, so that the shavings in the gap do not easily move. Thus, even when the shavings are generated, the shavings do not easily enter the pre-chamber 52. Therefore, the occurrence of pre-ignition due to the shavings serving as a source can be reduced.

Figure 7:
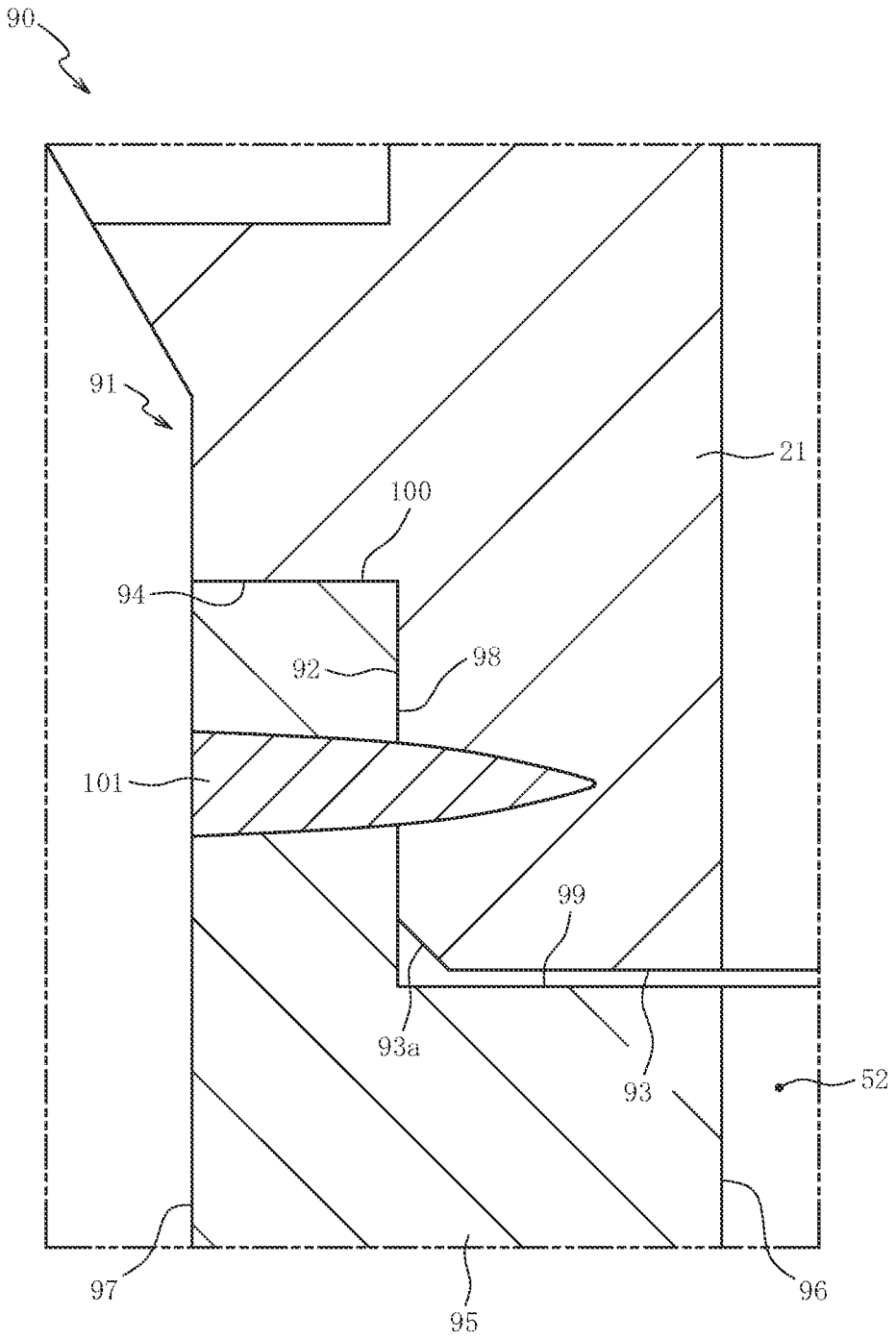
FIG. 7 is a sectional view of a spark plug according to a fourth embodiment.

A fourth embodiment will now be described with reference to FIG. 7. In the first to third embodiments, the inner facing surface 56 of the cap member 50, 71, 81 is positioned further back from the outer facing surface 58. In contrast, in the fourth embodiment, an inner facing surface 99 of a cap member 95 is positioned in front of an outer facing surface 100. Components that are the same as those described in the first embodiment are denoted by the same reference signs, and description thereof will be omitted, FIG. 7 is a sectional view of a spark plug 90 according to the fourth embodiment.

The spark plug 90 is configured such that the cap member 95 is joined to the front end portion 21 of a metal shell 91 by a welded portion 101. An inner surface 96 of the cap member 95 faces the pre-chamber 52, and an outer surface 97 of the cap member 95 faces the combustion chamber 3 (see FIG. 1). The welded portion 101 is formed by melting the cap member 95 and the metal shell 91. The welded portion 101 extends along the entire circumference of the metal shell 91 and the cap member 95.

The cap member 95 includes an overlapping surface 98 that faces the front end portion 21 of the metal shell 91 along the axial line direction (up-down direction in FIG. 7); the inner facing surface 99 that faces the front end portion 21 of the metal shell 91 in the axial line direction and that is positioned closer to the pre-chamber 52 than is the overlapping surface 98; and the outer facing surface 100 that faces the front end portion 21 of the metal shell 91 in the axial line direction and that is positioned outside (closer to the combustion chamber 3 than) the overlapping surface 98.

The overlapping surface 98 is an inwardly facing cylindrical surface of the cap member 95, and extends over the entire circumference of the cap member 95. The overlapping surface 98 is in contact with a first surface 92 of the metal shell 91, which is an outwardly facing cylindrical surface. The inner facing surface 99 is a back-facing annular surface, and extends over the entire circumference of the cap member 95. The inner facing surface 99 intersects the inner surface 96 of the cap member 95. The inner facing surface 99 is spaced from a second surface 93 of the metal shell 91, which is a front-facing annular surface. The distance between the inner facing surface 99 of the cap member 95 and the second surface 93 of the metal shell 91 in the axial line direction (gap size) is, for example, about 0.02 mm to about 0.8 mm.

The outer facing surface 100 is a back-facing annular surface, and extends over the entire circumference of the cap member 95. The outer facing surface 100 intersects the outer surface 97 of the cap member 95. The outer facing surface 100 is positioned further back from the inner facing surface 99.

The corner between the first surface 92 and the second surface 93 of the metal shell 91 is chamfered so that the corner is obliquely cut off to form an inclined surface **93*a* that extends over the entire circumference of the metal shell 91. Since the metal shell 91 has the inclined surface 93*a*, the metal shell 91 can be easily inserted into the space inside the overlapping surface 98 of the cap member 95**.

To form the welded portion 101 in the process of manufacturing the spark plug 90, the metal shell 91 is inserted into the cap member 95 such that the first surface 92 of the metal shell 91 slides along the overlapping surface 98 of the cap member 95 until the outer facing surface 100 of the cap member 95 comes into contact with the third surface 94 of the metal shell 91. The cap member 95 is temporarily attached to the metal shell 91 due to friction between the overlapping surface 98 and the first surface 92 of the metal shell 91. In this state, the cap member 95 and the metal shell 91 are melted by, for example, irradiation with a laser beam to form the welded portion 101. Thus, the cap member 95 is joined to the metal shell 91.

Although the inner facing surface 99 cannot be checked from the outside of the cap member 95, the manner in which the outer facing surface 100 of the cap member 95 is in contact with the third surface 94 of the metal shell 91 can be checked from the outside of the cap member 95. By controlling the positional accuracies of the third surface 94 of the metal shell 91 and the outer facing surface 100 of the cap member 95 and confirming that no foreign object or the like is present between the third surface 94 and the outer facing surface 100 from the outside of the cap member 95, the length of the cap member 95 from the metal shell 91 in the axial line direction can be controlled with reference to the outer facing surface 100 that is in contact with the third surface 94. Therefore, compared to the case in which the cap member 95 that is not yet joined is positioned in the axial line direction with reference to the inner facing surface 99, which cannot be checked from the outside of the cap member 95, variation in the length of the cap member 95 from the metal shell 91 in the axial line direction can be reduced.

Although the present invention has been described based on embodiments, the present invention is not limited to the above-described embodiments in any way, and it can be easily understood that various improvements and modifications are possible within the spirit of the present invention. For example, the shape of the cap member 50, 71, 81, 95 and the number, shapes, sizes, etc., of the through holes 51 are merely examples, and may be set as appropriate.

Although the ground electrode 40 that extends through the front end portion 21 of the metal shell 20, 91 is disposed at a position where the external thread 22 is provided in the above-described embodiments, the configuration is not necessarily limited to this. For example, the configuration may, of course, instead be such that an inner portion of the second surface 29, 93 of the metal shell 20, 91 protrudes inward beyond the inner surface 53, 96 of the cap member 50, 71, 81, 95 and that the ground electrode is connected to the protruding portion of the second surface 29, 93. The ground electrode may be either straight or bent. The ground electrode may instead be joined to the cap member.

Although the end portion 41 of the ground electrode 40 is disposed in front of the center electrode 13 so that the spark gap 42 is formed in front of the center electrode 13 in the above-described embodiments, the spark gap 42 is not necessarily limited to this. For example, the end portion 41 of the ground electrode 40 may, of course, be spaced from a side surface of the center electrode 13 so that the spark gap 42 is formed between the side surface of the center electrode 13 and the end portion 41 of the ground electrode 40. In addition, a plurality of ground electrodes 40 may, of course, be provided to form a plurality of spark gaps 42.

Although the first surface 28, 92 of the metal shell 20, 91 is in contact with the overlapping surface 55, 98 of the cap member 50, 71, 81, 95 (fit tolerance is set to achieve an interference fit) in the above-described embodiments, the configuration is not necessarily limited to this. The fit tolerance between the first surface 28, 92 and the overlapping surface 55, 98 may, of course, instead be set to achieve a loose fit or an intermediate fit instead of an interference fit, so that a clearance is provided between the first surface 28, 92 and the overlapping surface 55, 98.

Although the welded portion 59, 101 is formed by laser beam welding in the above-described embodiments, the welding method is not necessarily limited to this. The welded portion 59, 101 may, of course, instead be formed by other means. Examples of other means include arc welding and electron beam welding.

Although the metal shell 20, 91 and the cap member 50, 71, 81, 95 are joined together by forming the welded portion 59, 101 in the above-described embodiments, the joining method is not necessarily limited to this. For example, the cap member 50, 71, 81, 95 may, of course, be joined (fixed) to the metal shell 20, 91 without forming the welded portion 59, 101 by setting the fit tolerance between the metal shell 20, 91 and the cap member 50, 71, 81, 95 to achieve an interference fit.

Although the metal shell 20 and the entirety of the outer facing surface 60 (see FIG. 3) of the cap member 50, 71, 81 are melted to form the welded portion 59 in the above-described embodiments, the welded portion 59 is not necessarily limited to this. For example, a portion of the metal shell 20 that is positioned further back from the outer facing surface 60 of the cap member 50, 71, 81 may, of course, be irradiated with a laser beam in a direction substantially perpendicular to the axial line O (see FIG. 1), so that the overlapping surface 55 of the cap member 50, 71, 81 is melted to form a welded portion. The outer facing surface 60 of the cap member 50, 71, 81 may be melted either partially or entirely to form a welded portion. When the outer facing surface 60 of the cap member 50, 71, 81 is partially melted to form a welded portion, the cap member 50, 71, 81 includes both the outer facing surface 58, which is a boundary surface of the welded portion 59, and the outer facing surface 60 that is not melted.

Alternatively, a portion of the cap member 50, 71, 81 that is in front of the outer facing surface 60 of the cap member 50, 71, 81 may, of course, be irradiated with a laser beam at an angle with respect to the axial line O so that the outer facing surface 60 and the overlapping surface 55 of the cap member 50, 71, 81 are melted to form a welded portion. Also in this case, the outer facing surface 60 of the cap member 50, 71, 81 may be melted either partially or entirely to form a welded portion. When the outer facing surface 60 of the cap member 50, 71, 81 is partially melted to form a welded portion, the cap member 50, 71, 81 includes both the outer facing surface 58, which is a boundary surface of the welded portion 48, and the outer facing surface 60 that is not melted.

Although the welded portion 101 is formed between the first surface 92 of the metal shell 91 and the overlapping surface 98 of the cap member 95 in the above-described fourth embodiment, the welded portion 101 is not necessarily limited to this. The third surface 94 of the metal shell 91 and the outer facing surface 100 of the cap member 95 may, of course, instead be melted to form a welded portion.

Although the inclined surface 93*a* is formed on the corner between the first surface 92 and the second surface 93 of the metal shell 91 in the above-described fourth embodiment, the corner is not necessarily limited to this. This corner may, of course, be rounded instead of forming the inclined surface 93*a*. In addition, the corner between the overlapping surface 98 and the outer facing surface 100 of the cap member 95 may, of course, also be chamfered or rounded to facilitate insertion of the metal shell 91 into the cap member 95.

Although the corner between the overlapping surface 55 and the inner facing surface 56 of the cap member 50, 71 is chamfered or rounded in the above-described embodiments, a recess may, of course, be formed at the corner between the first surface 28 and the second surface 29 of the metal shell 20 in addition to or instead of chamfering or rounding the corner of the cap member 50, 71. When the metal shell 20 has the recess, a space (recess) capable of receiving shavings can be formed between the metal shell 20 and the cap member 50, 71, 81. Therefore, the shavings do not easily move toward the pre-chamber 52. In particular, the recess at the corner is preferably formed in the second surface 29. In such a case, the path from the recess to the pre-chamber 52 through the space between the second surface 29 and the inner facing surface 56 is bent because the recess is formed in the second surface 29. Accordingly, the shavings in the recess do not easily move toward the pre-chamber 52.

REFERENCE SIGNS LIST

10, 70, 80, 90 spark plug
13 center electrode
20, 91 metal shell
21 front end portion of metal shell
40 ground electrode
41 end portion of ground electrode
42 spark gap
50, 71, 81, 95 cap member
51 through hole
52 pre-chamber
55, 98 overlapping surface
56, 99 inner facing surface
57 inclined surface (chamfered surface)
58, 60, 100 outer facing surface
72 curved surface (rounded surface)
O axial line

What is claimed is:

1. A spark plug, comprising:

a metal shell having a tubular shape and extending along an axial line in a direction from front to back;

a center electrode retained inside an inner periphery of the metal shell in an insulated manner;

a ground electrode that is electrically connected to the metal shell and that defines a spark gap between the center electrode and an end portion of the ground electrode; and a cap member that is joined to the metal shell, that covers the center electrode and the end portion of the ground electrode from the front to define a pre-chamber, and in which a through hole is formed, the cap member comprising:

an overlapping surface that overlaps a front end portion of the metal shell along the axial line direction;

an inner facing surface positioned closer to the pre-chamber than is the overlapping surface of the cap member, the inner facing surface of the cap member facing the metal shell in the axial line direction; and an outer facing surface positioned closer to an outer periphery than is the overlapping surface of the cap member, the outer facing surface of the cap member facing the metal shell in the axial line direction, wherein a portion of the cap member that is closer to the pre-chamber than is the overlapping surface of the cap member is spaced from the metal shell, wherein the metal shell and the cap member are joined together at one or more of the outer facing surface of the cap member and the overlapping surface of the cap member, wherein the metal shell has a first surface and a second surface positioned at the front end portion of the metal shell, the first surface of the metal shell facing inwardly toward the pre-chamber and being overlapped by the overlapping surface of the cap member, the second surface of the metal shell facing the front and being spaced from the inner facing surface of the cap member, and wherein the inner facing surface of the cap member and the second surface of the metal shell are positioned further to the front than the ground electrode.

2. The spark plug according to claim 1, wherein the inner facing surface of the cap member is positioned further back from the outer facing surface of the cap member in the axial line direction, wherein the overlapping surface of the cap member is in contact with the metal shell, and wherein a corner between the inner facing surface of the cap member and the overlapping surface of the cap member is chamfered or rounded.

3. The spark plug according to claim 2, wherein the corner is rounded.

* * * * *